US005943530A

United States Patent [19]

Ozasa

[11] Patent Number: 5,943,530

[45] Date of Patent: Aug. 24, 1999

[54] IMAGE FORMING APPARATUS WITH AN INCREASED TONER ADHESION FEATURE

[75] Inventor: Takeshi Ozasa, Yokohama, Japan

[73] Assignee: Canon Kabushiki Kaisha, Tokyo, Japan

[21] Appl. No.: 08/888,606

[22] Filed: Jul. 7, 1997

[30] Foreign Application Priority Data

Jul. 10, 1996 [JP] Japan ..... 8-181061

[51] Int. Cl.[6] ..... G03G 21/00

[52] U.S. Cl. ..... 399/129; 399/315; 399/398

[58] Field of Search ..... 399/128, 129, 399/264, 315, 397–399

[56] References Cited

U.S. PATENT DOCUMENTS 4,956,677 9/1990 Akiyama ..... 399/129

5,392,108 2/1995 DeWaters et al. ..... 399/399

5,526,106 6/1996 Katsumi et al. ..... 399/315

5,663,788 9/1997 Sanpe ..... 399/315 X

*Primary Examiner*—William Royer

*Attorney, Agent, or Firm*—Fitzpatrick, Cella, Harper & Scinto

[57] ABSTRACT

An image-forming apparatus is disclosed. Unstably charged toner contained in a developer is attached to the surface of an image carrier by a developing sleeve for use in a developer unit. This toner is allowed to pass through the transfer position while keeping from contacting a transfer material. The toner is then uniformly charged by a pre-transfer charger or a separating charger to the same polarity as the developed normal toner. This increases an adhesion force of the toner to the surface of the image carrier, thereby preventing its attachment to a separating claw.

19 Claims, 4 Drawing Sheets

IMAGE FORMING APPARATUS WITH AN INCREASED TONER ADHESION FEATURE

BACKGROUND OF THE INVENTION

1. Field of the Invention

The present invention relates to electrophotographic image-forming apparatuses, for example, copying machines and laser beam printers.

2. Related Background Art

In a typical electrophotographic image-forming apparatus, image formation can be achieved by the following process. A toner image is formed on a photosensitive drum serving as an image carrier by toner-image forming means constructed of a charger, an exposure unit, and a developer unit. Then, the formed toner image is transferred by transfer means to a transfer material, such as a sheet of paper, which is then separated from the surface of the photosensitive drum by separating means. Subsequently, the toner image on the transfer material is fixed by a fixing unit.

As the above-described separating means, a separating charger and a discharging needle are known by way of example. Further, a combination of the above-mentioned separating charger or the discharging needle and a separating claw used as a detaching member is known as the separating means. This claw is located downstream of the separating charger or the discharging needle and upstream of a cleaner in a direction in which the drum is rotated. The claw separates a transfer material from the surface of the photosensitive drum by inserting its tip end between the surface of the drum and the forward end of the transfer material. It is required that the separating claw be constantly in touch with the surface of the photosensitive drum during a copying operation.

Meanwhile, during a start-up operation of an image-forming apparatus (when a main power supply is switched on) or during an idling operation, i.e., an occasion other than a copying operation, a developing sleeve of the developer unit is rotated and a bias voltage is applied to the developing sleeve to allow toner with unstable electric charges (hereinafter referred to as "unstably charged toner"), such as inverting toner or fog toner, within a developer unit to adhere to the photosensitive drum, thereby substantially maintaining a constant developing density (preventing a change in density). The unstably charged toner includes toner having low tribo-electricity charged with a polarity opposite to a charging polarity of the normal toner, and toner having tribo-electricity lower than the normal toner.

Accordingly, during an occasion, such as a start-up operation and an idling operation, other than copying operation of the image-forming apparatus, the inverting toner or the fog toner attached to the surface of the photosensitive drum transferred from the developer unit is unfavorably caused to adhere to the separating claw serving as a contact member. This toner may disadvantageously drop onto the charger or images formed on the initial few transfer sheets and deface them when a copying operation is performed, i.e., what is referred to as "toner dropping" is generated.

To solve this problem, the following measures may be taken:

(1) providing a contact-releasing mechanism for the separating claw used as the contact member being in contact with the surface of the photosensitive drum; the mechanism is actuated to separate the claw from the surface of the photosensitive drum when the developing sleeve is rotated to apply a developing bias thereto during a start-up operation or an idling operation, and once again to bring the claw into contact with the surface of the drum when a copying operation is started; and (2) performing a specific sequence in which a process of rotating and biasing a developing sleeve is omitted depending on the degree of reduction in developer density in order to avoid "toner dropping" from the separating claw.

However, despite the aforedescribed measures, the following problems still remain. The provision of a contact-releasing mechanism for the separating claw proposed in (1) increases the number of parts and the complexity of the construction of the image-forming apparatus. The specific sequence described in (2) still exhibits a reduction in density, which does not solve the fundamental problem.

SUMMARY OF THE INVENTION

Accordingly, it is an object of the present invention to provide an image-forming apparatus which substantially maintains constant image density by decreasing the amount of unstably charged toner in a developer unit.

It is another object of the present invention to provide an image-forming apparatus which reduces the frequency of the attachment of toner to a detaching member.

It is still another object of the present invention to provide an image-forming apparatus that keeps a detaching member in contact with an image carrier without needing to provide a mechanism for separating the member from the carrier.

It is a further object of the present invention to provide an image-forming apparatus that increases an electrostatic adhesion force between an image carrier and unstably charged toner attached to the image carrier.

Further objects, features and advantages of the present invention will become apparent from the following description of the preferred embodiments with reference to the attached drawings.

DETAILED DESCRIPTION OF THE PREFERRED EMBODIMENTS

Preferred embodiments of the present invention will now be described with reference to the drawings.

First Embodiment

Figure 1:
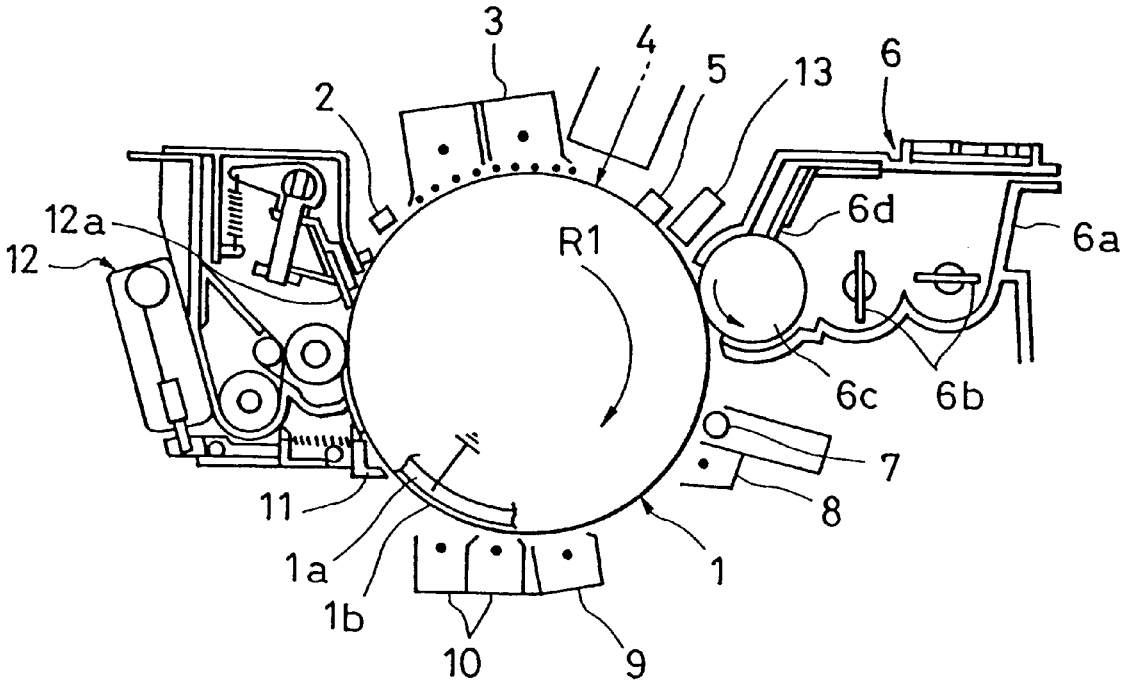
FIG. 1 is a longitudinal sectional schematic view illustrating an image-forming apparatus according to a first embodiment of the present invention.

FIG. 1 is a longitudinal sectional schematic view illustrating the construction of the elements located in the vicinity of a photosensitive drum for use in an image-forming apparatus according to the present invention.

Referring to FIG. 1, the image-forming apparatus has a drum-shaped electrophotographic-type photosensitive member serving as an image carrier (hereinafter referred to as "the photosensitive drum") 1. The photosensitive drum 1 is formed, for example, by depositing an organic photosemiconductor (OPC)-made photosensitive layer 1*b* on the surface of a grounded cylindrical conductive aluminum base member 1*a*. The drum 1 is rotatably supported by the main unit (not shown) of the image-forming apparatus. The photosensitive layer 1*b* may be made of amorphous silicon. Connected to one end of the photosensitive drum 1 in a direction along its axis is a driving mechanism and a driving source (neither of them are shown) for rotating the overall drum 1 in the direction indicated by the arrow R1 shown in FIG. 1.

Disposed around the photosensitive drum 1 substantially in the order along the direction in which the drum 1 is rotated are a pre-exposure LED (pre-exposure unit) 2, a primary charger 3, an exposure unit (light indicated by the arrow in the exposure unit 4 shown in FIG. 1 is emitted from exposure means) 4, a blank exposure LED (blank exposure unit) 5, a developer unit (developing means) 6, a roller electrode (toner collecting electrode) 7, a pre-transfer charger (charger) 8, a transfer charger 9, a separating charger (charger) 10, a separating claw 11 serving as a detaching member, and a cleaner 12. These elements will now be explained starting from the pre-exposure LED 2.

The pre-exposure LED 2 serves to make the potential on the surface of the photosensitive drum 1 uniform by removing residual potential remaining on the drum 1 after the surface has been cleaned. The primary charger 3, formed of, for example, a Scoroton-type Corona charger, uniformly charges the surface of the photosensitive drum 1, for example, at a predetermined negative potential.

The exposure unit 4 serves to irradiate the surface of the photosensitive drum 1 with exposure light according to the image information, and is formed of, for example, a laser diode for emitting exposure light, a polygonal mirror, and a lens (neither of them are shown). Part of the surface of the photosensitive drum 1 irradiated with the exposure light is discharged where an electrostatic latent image corresponding to the image information can be formed.

The blank exposure LED 5 is used for creating white blanks at the forward and rear ends and the left and right edges of a transfer material by exposing part of the photosensitive drum 1 corresponding to the above-mentioned white blanks in relation to the electrostatic latent image formed on the surface of the drum 1 by the above-described exposure unit 4.

The developer unit (developing device) 6 has a developing container 6*a* for storing a developer, an agitation member 6*b* which provides negative electric charge for the developer while agitating the developer, a developing sleeve 6*c* (a developer carrier) for carrying a developer on its surface and feeding the developer to the developing position opposedly facing the photosensitive drum 1, and a restricting blade 6*d* for restricting the thickness of the layer of the developer carried on the developing sleeve 6*c*. The toner carried on the surface of the developing sleeve 6*c* is transferred to the developing position. A direct-current developing bias DC (negative polarity) and alternating-current developing bias AC are applied to the developing sleeve 6*c* from a power supply (not shown). The toner is then attached to the electrostatic latent image on the photosensitive drum 1, thereby developing the latent image as a toner image. As the developer, either of a two-component developer essentially consisting of a non-magnetic negative toner and a magnetic carrier, or a monocomponent developer consisting of a magnetic toner may be used. In this embodiment, normal toner is charged at a negative polarity.

The roller electrode 7 serves to collect unstably charged toner contained in normal toner which forms a toner image on the photosensitive drum 1, thereby protecting the below-described transfer charger 9 and the separating charger 10 from being defaced. The unstably charged toner includes toner charged with a polarity opposite to the normal toner and toner having tribo-electricity lower than the normal toner.

The pre-transfer charger 8 provides the uniformity of electric charge forming a toner image on the photosensitive drum 1, thereby making it possible to stably transfer the toner image to a transfer material. In this embodiment, a negative voltage is applied to the pre-transfer charger 8 to uniformly negatively charge a toner image. The transfer charger 9 is actuated to transfer a toner image formed on the photosensitive drum 1 to a transfer material in a transfer position; a transfer bias with a polarity opposite to a charging polarity of the toner image on the drum 1 is applied to the transfer charger 9 from a transfer power supply (not shown).

The separating charger 10, used for separating a transfer material from the surface of the photosensitive drum 1, eliminates the transfer electric charge of the transfer material so as to facilitate the separation of the material from the drum 1. In this embodiment, an AC voltage is superimposed on a DC voltage with a polarity opposite to the charging polarity of the transfer bias, and the superimposed voltage is then applied to the separating charger 10.

The separating claw 11 separates, in conjunction with the above-described separating charger 10, a transfer material with a toner image from the photosensitive drum 1, thereby blocking the transfer material from entering the cleaner 12. The claw 11 detaches the transfer material from the photosensitive drum 1 by inserting its tip end between the surface of the drum 1 and the forward end of the transfer material. It should be noted that the separating claw 11 is constantly in contact with the photosensitive drum 1 devoid of a mechanism for separating the claw 11 from the drum 1. Namely, the separating claw 11 keeps in contact with the surface of the drum 1 regardless of whether the transfer material reaches the separating position.

The cleaner 12 is provided with a cleaning blade 12*a* abutting against the surface of the drum 1 in the cleaning position, thereby eliminating, what is referred to as "residual toner", which has not been transferred to the transfer material but remains on the drum 1. Reference numeral 13 shown in FIG. 1 indicates a potential sensor for detecting the surface potential of the photosensitive drum 1.

The transfer material, carrying a not-yet-fixed toner image on its surface, is separated from the surface of the photosensitive drum 1 and is fed to a fixing unit (unillustrated) disposed downstream of the drum 1. In the fixing unit, the toner image is fixed on the surface of the transfer material by heating and pressurizing, and then output to the exterior of the main unit of the image-forming apparatus.

Figure 2:
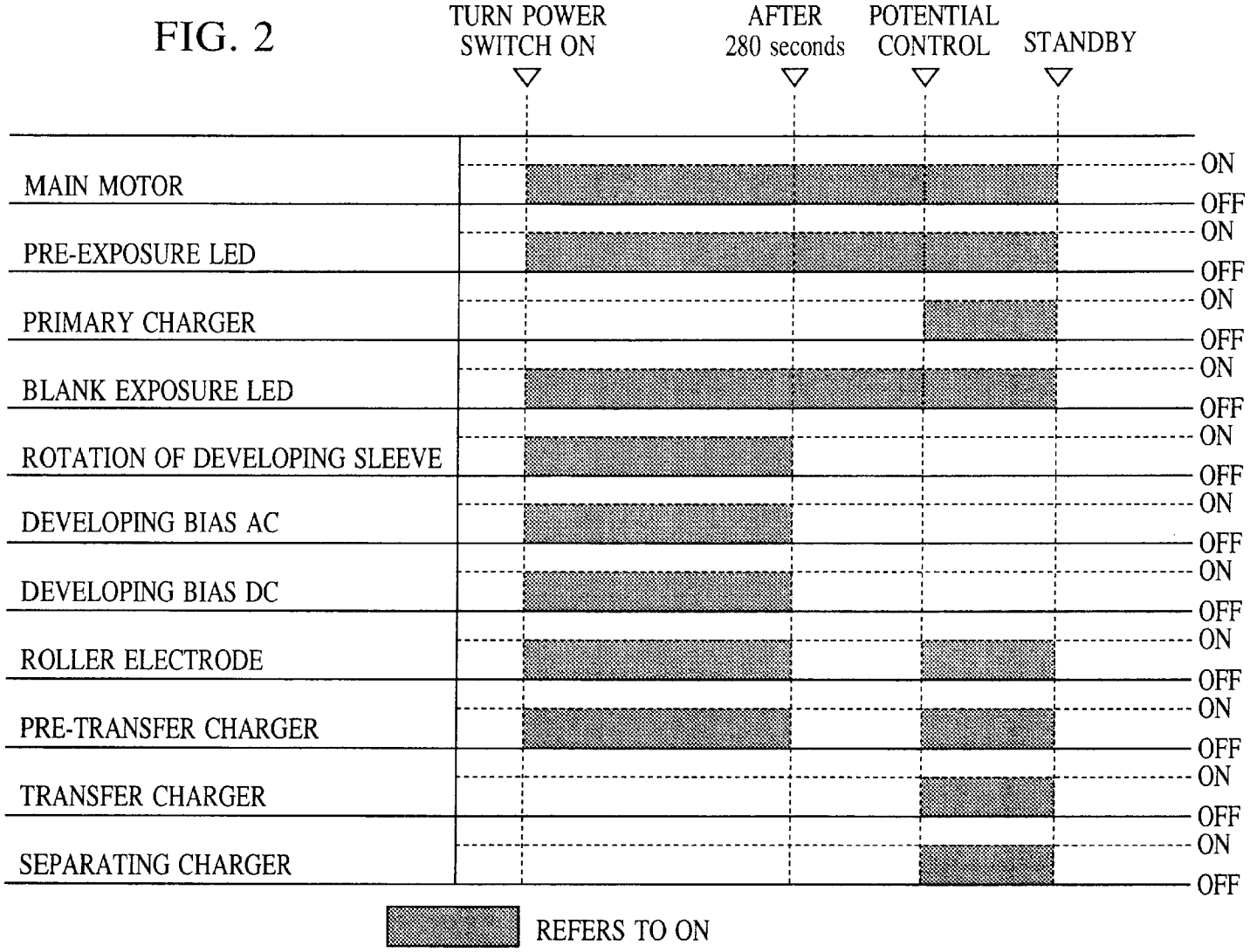
FIG. 2 is a timing chart illustrating the operation of the image-forming apparatus according to the first embodiment of the present invention.

FIG. 2 is a timing chart illustrating the operation of the individual elements for use in the image-forming apparatus. FIG. 2 represents a sequence of the period (copy warm-up period) from the actuation of the power supply switch (main power supply) to the start of a copy standby mode in which the image-forming apparatus is ready to copy. In order to transfer unstably charged toner, such as inverting toner and fog toner, from the developer unit 6 to the photosensitive drum 1, the drum 1 idles, as illustrated in FIG. 2, for 280 seconds after the power supply switch has been turned on. Then, potential control is performed until the standby mode is started. More specifically, the potential of the photosensitive drum 1 while image formation is performed is controlled based on the potential detected by the sensor 13; in other words, the voltage to be applied to the primary charger 3 and the amount of exposure of the exposure unit 4 are controlled. The black portions indicated in FIG. 2 designate the actuation state of the individual elements. During the period from the actuation of the power supply switch to the start of the standby mode, warming-up of the fixing unit and potential initialization of the image carrier are also performed.

In the image-forming apparatus constructed as described above, when the power supply switch is actuated, a main motor is started to drive the photosensitive drum 1, causing it to start rotating. At this time, the pre-exposure LED 2 and the blank exposure LED 5 are lit so as to approximate the surface potential of the drum 1 to 0 V and also to empty the potential memory of the drum 1. Simultaneously, the developing sleeve 6*c* located within the developer unit 6 is rotated, and AC developing bias and DC developing bias (negative polarity) are applied to the sleeve 6*c*, thereby causing unstably charged toner, such as low tribo-electricity toner, to adhere to a region of the photosensitive drum 1 in which a latent image corresponding to certain image information is not formed (hereinafter referred to as "the non-latent-image region"). This makes it possible to stabilize the development density obtained during a copying operation, which will be started subsequent to the standby mode.

At this time, the roller electrode 7 located downstream of the developer unit 6 in a direction in which the drum 1 is rotated is biased, and further, the pre-transfer charger 8 is discharged to uniformly charge unstably charged toner on the drum 1 to the same polarity (negative) as the normal toner. This toner is then removed by the cleaning blade 12*a* after it has passed through the transfer position while keeping from contacting a transfer material.

Voltages applied to the above-described developer unit 6 and the roller electrode 7, and the current flowing in the pre-transfer charger 8 will now be explained more specifically.

The AC developing bias component applied to the developer unit 6 has a peak-to-peak voltage Vpp of 1.5 kV and a frequency of 2.4 kHz, while the DC developing bias component to the developer unit 6 is −100 V. Further, a DC voltage of −1 kV is applied to the roller electrode 7, while a current of −300 $\mu$A is caused to flow in the pre-transfer charger 8.

Under the conditions noted above, unstably charged toner on the photosensitive drum 1 can be uniformly negatively charged, thereby making it possible to prevent adhesion of the toner to the separating claw 11 which maintains contact with the drum 1. This can significantly decrease the frequency of "toner dropping" from the separating claw 11, which conventionally occurs immediately after an idling operation is started, such as during a start-up operation of the image-forming apparatus. It should be noted that charging the unstably charged toner to the same polarity as the charging polarity of the normal toner is preferable as compared with charging to the opposite polarity, in order to strengthen the adhesive force between the toner and the surface of the drum 1.

The aforedescribed embodiment has been explained in such a manner that negative toner is used as the normal toner. Positive toner may be, however, employed in a manner similar to negative toner, in which case, a voltage with the same polarity as the normal toner, i.e., a positive voltage, is applied to the roller electrode 7. It is needless to say that the pre-transfer charger 8 charges the unstably charged toner to the same polarity as the normal toner. Advantages similar to those offered by the use of negative toner can be obtained.

The conditions set in the above-described embodiment are provided by way of example only, and may sometimes differ between individual elements. In particular, a current flowing in the pre-transfer charger 8 may be −100 $\mu$A or lower, and more preferably, −300 $\mu$A or lower, attaining more remarkable advantages.

Additionally, even if only an AC or DC bias is applied to the developing sleeve 6*c*, the construction of the present invention is still effective.

Second Embodiment

Figure 3:
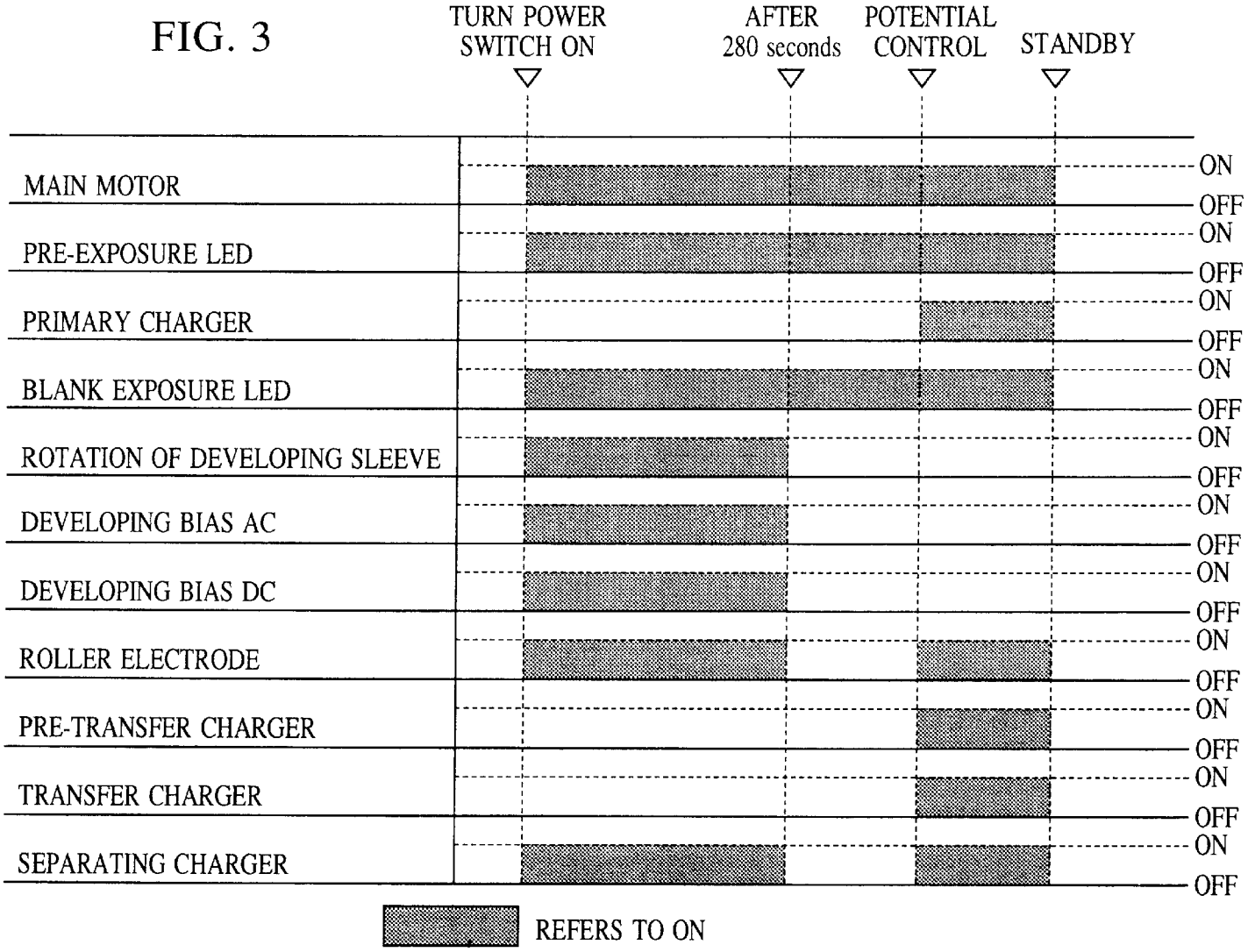
FIG. 3 is a timing chart illustrating the operation of an image-forming apparatus according to a second embodiment of the present invention.

FIG. 3 is a timing chart illustrating the operation of an image-forming apparatus according to a second embodiment of the present invention.

Referring to FIG. 3, although the second embodiment is basically constructed and operated similar to the first embodiment, the second embodiment differs from the first embodiment in that the separating charger 10 is used to charge unstably charged toner in place of the pre-transfer charger 8 employed in the first embodiment. The current flowing in the separating charger 10 is −300 $\mu$A.

In this manner, the separating charger 10 may be substituted for the pre-transfer charger 8 to charge unstably charged toner as described in the first embodiment. The separating charger 10 is positioned closer to the separating claw 11 than the pre-transfer charger 8 is, so that toner charge can exhibit a larger force in the separating position as compared with the use of the pre-transfer charger 8, thereby enhancing the effect of preventing the attachment of toner to the separating claw 11.

Third Embodiment

Figure 4:
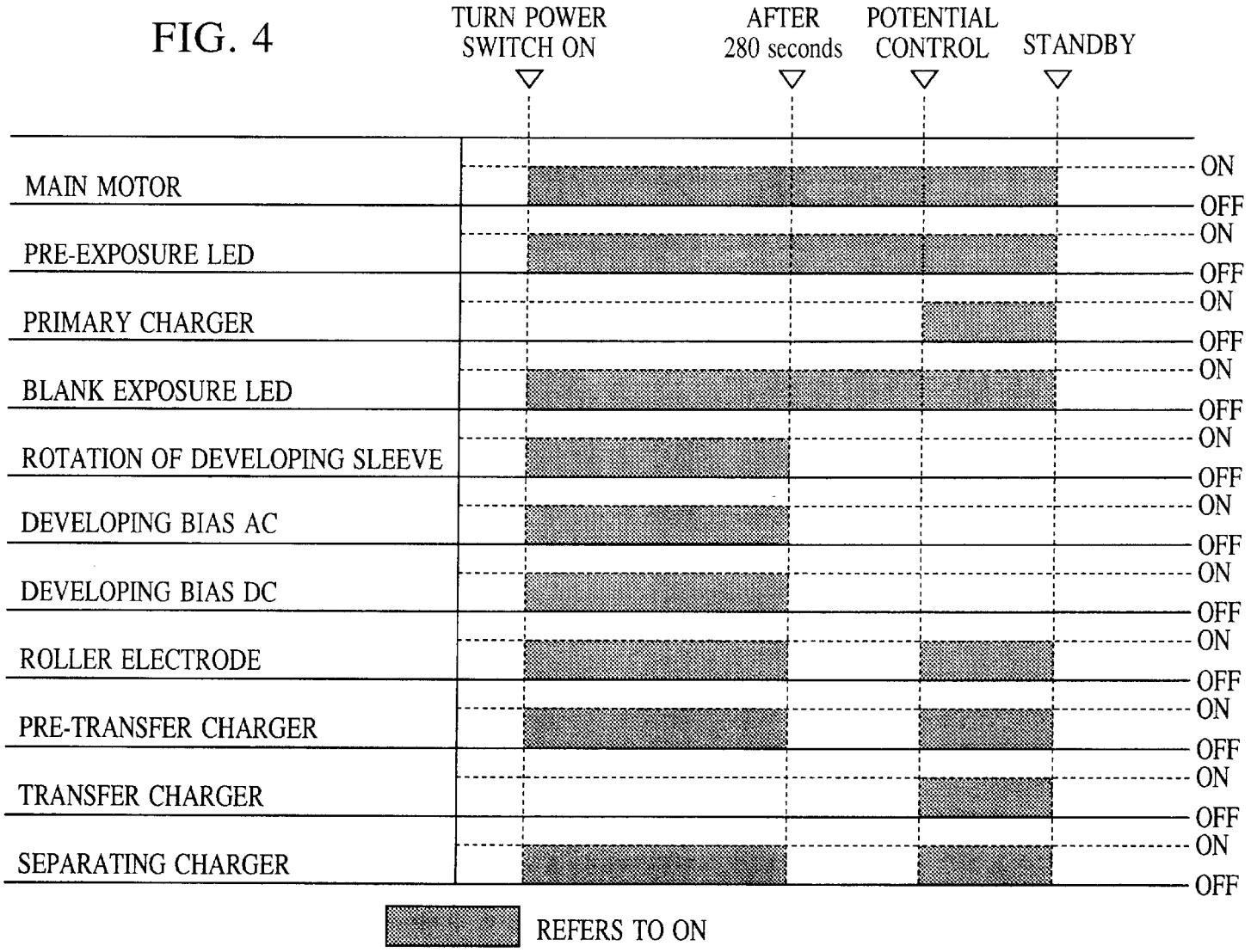
FIG. 4 is a timing chart illustrating the operation of an image-forming apparatus according to a third embodiment of the present invention.

FIG. 4 is a timing chart illustrating the operation of an image-forming apparatus according to a third embodiment of the present invention.

Although this embodiment is fundamentally constructed and operated in a manner similar to the first and second embodiments, the third embodiment is different from the previous embodiments in that both the pre-transfer charger 8 and the separating charger 10 are used to charge unstably-charged toner attached to the photosensitive drum 1, thereby further increasing toner charge and improving the effect of inhibiting the attachment of toner to the separating claw 11.

Fourth Embodiment

In a fourth embodiment, a roller charger and a discharging needle (a discharging member provided with a discharging tip) are used in place of the pre-transfer charger 8 and the separating charger 10, respectively, employed in the first through third embodiments. In this case, advantages similar to those exhibited by the foregoing embodiments can be achieved. Additionally, the transfer charger 9 may be employed to charge the unstably charged toner to the same polarity as the normal toner by applying a voltage with a polarity opposite to the voltage applied to a toner image to be transferred.

In short, according to the present invention, the chargers for use in the image-forming apparatus may be constructed as desired as long as the unstably charged toner can be effectively charged in a position between the developing sleeve 6*c* and the separating claw 11.

In all of the foregoing embodiments, when an image is continuously formed on a plurality of transfer materials, the unstably charged toner may be attached to a specific region (sheet interval region) of the photosensitive drum corresponding to the region between adjacent transfer materials.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising:

an image carrier;

image-forming means for forming a toner image on said image carrier, said image-forming means comprising developing means for developing an electrostatic image formed on said image carrier in a developing position with the use of toner, said developing means causing unstably charged toner to adhere to said image carrier and the unstably charged toner passing through a transfer position while keeping the toner from contacting a transfer material;

transfer means for transferring the toner image from said image carrier to the transfer material in the transfer position;

a detaching member for separating the transfer material from said image carrier in a separating position by inserting said detaching member between said image carrier and the transfer material after the toner image is transferred to the transfer material; and charging means for charging the unstably charged toner attached on said image carrier to the same polarity as a charging polarity of normal toner forming the toner image, said charging means being located downstream of the developing position and upstream of the separating position in a moving direction of said image carrier, wherein a period from the actuation of a main power supply of said apparatus to the start of a standby mode of said apparatus comprises a period during which the unstably charged toner is attached to said image carrier.

2. An image-forming apparatus according to claim 1, further comprising cleaning means for cleaning in a cleaning position residual toner attached on said image carrier after passing through the separating position.

3. An image-forming apparatus according to claim 1, wherein said developing means comprises a rotatable developer carrier for carrying and conveying a developer to the developing position, said developer carrier being rotated when the unstably charged toner is attached to said image carrier.

4. An image-forming apparatus according to claim 1, wherein said detaching member keeps in contact with said image carrier regardless of the presence or absence of the transfer material in the separating position.

5. An image-forming apparatus according to claim 1, wherein said charging means comprises a pre-transfer charger for charging the toner image to the same polarity as the charging polarity of the normal toner before the toner image is transferred to the transfer material.

6. An image-forming apparatus according to one of claims 1 and 5, wherein said charging means comprises a separating charger for discharging the transfer material in order to separate the transfer material from said image carrier after the toner image is transferred to the transfer material.

7. An image-forming apparatus according to claim 5, wherein said pre-transfer charger comprises a corona discharger.

8. An image-forming apparatus according to claim 6, wherein said separating charger comprises a corona discharger.

9. An image-forming apparatus comprising:

an image carrier;

image-forming means for forming a toner image on said image carrier, said image-forming means comprising developing means for developing an electrostatic image formed on said image carrier in a developing position with the use of toner, said developing means causing unstably charged toner to adhere to said image carrier and the unstably charged toner passing through a transfer position while keeping the toner from contacting a transfer material;

transfer means for transferring the toner image from said image carrier to a transfer material in a transfer position;

cleaning means for cleaning residual toner attached on said image carrier in a cleaning position; and charging means for charging the unstably charged toner attached on said image carrier to the same polarity as a charging polarity of normal toner forming the toner image, said charging means being located downstream of the developing position and upstream of the cleaning position in a moving direction of said image carrier, wherein a period from the actuation of a main power supply of said apparatus to the start of a standby mode of said apparatus comprises a period during which the unstably charged toner is attached to said image carrier.

10. An image-forming apparatus according to claim 9, wherein said developing means comprises a rotatable developer carrier for carrying and conveying a developer to the developing position, said developer carrier being rotated when the unstably charged toner is attached to said image carrier.

11. An image-forming apparatus according to claim 9, further comprising a contact member which is in contact with said image carrier, located downstream of the transfer position and upstream of the cleaning position in the moving direction of said image carrier.

12. An image-forming apparatus according to claim 9, wherein said charging means comprises a pre-transfer charger for charging the toner image to the same polarity as the polarity of the normal toner before the toner image is transferred to the transfer material.

13. An image-forming apparatus according to one of claims 9 and 12, wherein said charging means comprises a separating charger for discharging the transfer material in order to separate the transfer material from said image carrier after the toner image is transferred to the transfer material.

14. An image-forming apparatus according to claim 12, wherein said pre-transfer charger comprises a corona discharger.

15. An image-forming apparatus according to claim 13, wherein said separating charger comprises a corona discharger.

16. An image-forming apparatus comprising:

an image carrier;

image-forming means for forming a toner image on said image carrier, said image-forming means comprising developing means for developing an electrostatic image formed on said image carrier in a developing position with the use of toner, said developing means causing unstably charged toner to adhere to said image carrier and the unstably charged toner passing through a transfer position while keeping the toner from contacting a transfer material;

transfer means for transferring the toner image from said image carrier to the transfer material in the transfer position;

a detaching member for separating the transfer material from said image carrier in a separating position by inserting said detaching member between said image carrier and the transfer material after the toner image is transferred to the transfer material; and charging means for charging the unstably charged toner attached on said image carrier to the same polarity as a charging polarity of normal toner forming the toner image, said charging means being located downstream of the developing position and upstream of the separating position in a moving direction of said image carrier, wherein said charging means comprises a separating charger for discharging the transfer material in order to separate the transfer material from said image carrier after the toner image is transferred to the transfer material.

17. An image-forming apparatus according to claim 16, wherein said separating charger comprises a corona discharger.

18. An image-forming apparatus comprising:

an image carrier;

image-forming means for forming a toner image on said image carrier, said image-forming means comprising developing means for developing an electrostatic image formed on said image carrier in a developing position with the use of toner, said developing means causing unstably charged toner to adhere to said image carrier and the unstably charged toner passing through a transfer position while keeping the toner from contacting a transfer material;

transfer means for transferring the toner image from said image carrier to a transfer material in a transfer position;

cleaning means for cleaning residual toner attached on said image carrier in a cleaning position; and charging means for charging the unstably charged toner attached on said image carrier to the same polarity as a charging polarity of normal toner forming the toner image, said charging means being located downstream of the developing position and upstream of the cleaning position in a moving direction of said image carrier, wherein said charging means comprises a separating charger for discharging the transfer material in order to separate the transfer material from said image carrier after the toner image is transferred to the transfer material.

19. An image-forming apparatus according to claim 18, wherein said separating charger comprises a corona discharger.

* * * * *